US009995553B1

(12) United States Patent
Oglesby

(10) Patent No.: US 9,995,553 B1
(45) Date of Patent: Jun. 12, 2018

(54) ADJUSTABLE BUFFER

(71) Applicant: Paul A. Oglesby, Darley (GB)

(72) Inventor: Paul A. Oglesby, Darley (GB)

( * ) Notice: Subject to any disclaimer, the term of this patent is extended or adjusted under 35 U.S.C. 154(b) by 0 days. days.

(21) Appl. No.: 15/379,045

(22) Filed: Dec. 14, 2016

Related U.S. Application Data

(60) Provisional application No. 62/269,962, filed on Dec. 19, 2015.

(51) Int. Cl.
*F41A 25/14* (2006.01)
*F41C 23/06* (2006.01)

(52) U.S. Cl.
CPC ..... *F41A 25/14* (2013.01); *F41C 23/06* (2013.01)

(58) Field of Classification Search
CPC ..... F41A 25/00; F41A 25/10; F41A 25/12; F41A 25/14; F41A 25/16; F41A 3/78; F41A 3/80; F41A 3/82; F41A 3/84; F41C 23/06
See application file for complete search history.

(56) References Cited

U.S. PATENT DOCUMENTS 2,504,958 A * 4/1950 Botts ..... F41A 25/14 89/198
5,909,002 A * 6/1999 Atchisson ..... F41A 3/84 42/1.06
6,829,974 B1 * 12/2004 Gwinn, Jr. ..... F41A 3/70 89/130
7,131,367 B1 * 11/2006 Boerschig ..... F41A 3/70 42/1.06
8,991,088 B1 * 3/2015 Young ..... F41A 25/00 42/75.03
9,080,823 B1 * 7/2015 Mantas ..... F41A 25/12
9,267,747 B2 * 2/2016 Caudle ..... F41A 3/84
9,395,148 B1 * 7/2016 Huang ..... F41C 23/06
9,488,423 B2 * 11/2016 Sullivan ..... F16J 9/16
9,625,232 B2 * 4/2017 Gomez ..... F41C 23/06
2013/0319217 A1 * 12/2013 Gangl ..... F41A 3/84 89/198
2014/0075798 A1 * 3/2014 Kincel ..... F41A 3/84 42/1.06
2014/0224112 A1 * 8/2014 Verry ..... F41A 19/03 89/130
2014/0260946 A1 * 9/2014 Gomez ..... F41A 5/18 89/191.01
2015/0345895 A1 * 12/2015 Young ..... F41A 11/04 42/71.01
2017/0067716 A1 * 3/2017 Huang ..... F41C 23/06

* cited by examiner

*Primary Examiner* — Benjamin P Lee
(74) *Attorney, Agent, or Firm* — Shaddock Law Group, PC

(57) ABSTRACT

An adjustable buffer optionally including at least some of a buffer element having an elongate buffer element body portion, wherein the buffer element body portion includes an externally threaded portion; a collar nut having a collar nut aperture formed therethrough, wherein at least a portion of the collar nut aperture is internally threaded so as to interact with the externally threaded portion of the buffer element body portion, and wherein one or more collar nut recesses are formed in the collar nut; and a locking collar having a locking collar aperture formed therethrough, wherein the locking collar aperture is formed so as to accept at least a portion of the buffer element body portion therethrough, wherein the locking collar includes one or more locking collar protrusions, and wherein the one or more locking collar protrusions are mateable with the one or more collar nut recesses.

20 Claims, 18 Drawing Sheets

ADJUSTABLE BUFFER

CROSS-REFERENCE TO RELATED APPLICATIONS

This patent application claims the benefit of U.S. Patent Application Ser. No. 62/269,962, filed Dec. 19, 2015, the entire disclosure of which is incorporated herein by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of firearms. More specifically, the present disclosure relates to an adjustable buffer for a firearm.

2. Description of Related Art

The AR-15 is based on the AR-10, which was designed by Eugene Stoner, Robert Fremont, and L. James Sullivan of the Fairchild ArmaLite Corporation in 1957. Today, there are numerous variants of the AR-15 that are manufactured by a number of companies. The AR-15 and its various related derivative platforms are used by civilians, law enforcement personnel, and military forces around the world.

Various firearms, such as, for example, the AR-15 or M-4 style firearms utilize a fixed or variable position buttstock. Typically, the variable position buttstock is slidable and lockable at various positions along a buffer tube.

The typical buffer tube includes a capped cylindrical portion having a threaded portion for installation into a buffer tube receiving aperture of a lower receiver. Typically, an end plate and a castle collar nut are utilized to complete installation of the buffer tube on the receiver.

During normal operation of a semiautomatic AR-15 style rifle, when a round is fired, gas from the burning propellant forces the bullet through the barrel. Before the bullet leaves the barrel, a portion of the gas enters a gas port in the upper part of the barrel under the front sight (or gas block). The gas port directs gas through a portion of the front sight (or gas block) and into the gas tube, which directs the gas into a cylinder between the bolt carrier and the bolt and drives the bolt carrier rearward.

The buffer, which is pushing on the rear of the bolt carrier group, is forced rearward by the bolt carrier group, compressing the buffer spring. During this rearward movement, a cam track in the upper portion of the bolt carrier acts on the bolt cam pin, rotating the cam pin and bolt clockwise so that the bolt locking lugs are unlocked from the barrel extension locking lugs. As the rearward movement of the bolt carrier group continues, the empty cartridge case is extracted from the chamber, and ejected through the ejection port.

As the bolt carrier group clears the top of an inserted magazine and the empty cartridge case is expelled, a new round is pushed into the path of the bolt by the upward thrust of the magazine follower and spring.

As the bolt carrier group continues to move rearward, it overrides the hammer and forces the hammer down into the receiver, compressing the hammer spring, and allowing the rear hook of the hammer to engage with the hammer disconnect.

When the bolt carrier group reaches its rearmost position (when the rear of the buffer contacts the bottom wall at the rear of the buffer tube), the compressed buffer spring expands, driving the buffer assembly forward with enough force to drive the bolt carrier group forward, toward the chamber, initiating chambering of the waiting round from the magazine into the chamber.

The forward movement of the bolt ceases when the locking lugs pass between the barrel extension locking lugs and the round is fully chambered. When the bolt carrier enters the final portion of its forward movement, the bolt cam pin emerges from the cam pin guide channel in the upper receiver and moves along the cam track, rotating the bolt counterclockwise. This rotation locks the bolt to the barrel extension (by interaction of the bolt locking lugs and the barrel extension locking lugs). The locking of the bolt completes the cycle of operation and, when the trigger is released, the rear hammer hook hammer slips from the disconnect and the front hammer hook is caught by the sear of the trigger. The firearm is then ready to be fired again.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

Unfortunately, the typical buffer does not allow the user to adjust the preload or tension of the buffer spring.

The disadvantages and shortcomings of the prior art are overcome by the features and elements of the adjustable buffer of the present disclosure. The advantages of the present disclosure are preferably attained by providing, in an exemplary, nonlimiting embodiment, the adjustable buffer includes an outer, threaded portion that allows a collar nut and a locking collar to be moved up and down the shaft or buffer body of the buffer element. The locking collar works against either a modified or a standard buffer spring. If utilized with a modified buffer spring, the modified buffer spring does not compress to solid height at the same length as a standard buffer. By not compressing to the solid height, if or when the adjustable buffer has reached its maximum length of travel in the buffer tube, the buffer spring is still not fully compressed.

By adjusting the collar nut and locking collar along the buffer body (via interaction of the externally threaded portion of the buffer body and the internally threaded portion of the collar nut) the buffer spring can be forced to compress further. This effect increases spring pressure on the buffer element and softens the recoil action of the firearm.

In various exemplary embodiments, sufficient adjustment of collar nut and locking collar is provided to allow the buffer element to be used in various barrel length rifles with different gas tube lengths and gas port diameters.

In certain exemplary, nonlimiting embodiments of the present disclosure, the adjustable buffer optionally includes at least some of a buffer element, wherein the buffer element comprises an elongate buffer element body portion extending from a buffer element head portion, wherein the buffer element body portion includes an externally threaded portion; a collar nut, wherein a collar nut aperture is formed through the collar nut, wherein at least a portion of the collar nut aperture is internally threaded, wherein the internally threaded portion is threaded so as to interact with the externally threaded portion of the buffer element body portion, and wherein one or more collar nut recesses are formed in the collar nut; and a locking collar, wherein a locking collar aperture is formed through the locking collar, wherein the locking collar aperture is formed so as to accept at least a portion of the buffer element body portion therethrough, wherein the locking collar includes one or more locking collar protrusions, and wherein the one or more locking collar protrusions are mateable with the one or more collar nut recesses.

In various exemplary, nonlimiting embodiments, the buffer element comprises an internal buffer element cavity defined by an open end, one or more side walls, and a bottom wall.

In various exemplary, nonlimiting embodiments, a weight element is positioned within the internal buffer element cavity. In various exemplary, nonlimiting embodiments, the weight element comprises a solid portion of material, a powdered or granulated material, or a liquid. In certain exemplary embodiments, the weight element comprises one or more tungsten weight elements, positioned within the internal buffer element cavity to provide additional weight to the adjustable buffer.

In various exemplary, nonlimiting embodiments, an alignment groove is formed in at least a portion of the buffer element body portion, wherein an alignment protrusion extends from a portion of the locking collar, and wherein interaction of the alignment groove and the alignment protrusion maintains the locking collar in a desired rotational position relative to the body element.

In various exemplary, nonlimiting embodiments, the alignment groove is formed along a longitudinal axis of the buffer element body portion.

In various exemplary, nonlimiting embodiments, the buffer element head portion has a greater outer diameter than an outer diameter of the buffer element body portion.

In various exemplary, nonlimiting embodiments, the adjustable buffer includes an end cap, wherein at least a portion of the end cap extends from the elongate buffer element body portion.

In various exemplary, nonlimiting embodiments, a position of the collar nut along the buffer element body portion can be adjusted by rotation of the collar nut relative to the buffer element body portion, via interaction of the externally threaded portion of the buffer element body portion and the internally threaded portion of the collar nut.

In various exemplary, nonlimiting embodiments, the locking collar aperture is sized so as to be repeatably slidable along at least a portion of the buffer element body portion.

In various exemplary, nonlimiting embodiments, when the locking collar is abutted against the collar nut, interaction of mating locking collar recesses and locking collar protrusions maintain the locking collar in a rotational position relative to the collar nut.

In various exemplary, nonlimiting embodiments of the present disclosure, the adjustable buffer optionally includes at least some of a buffer element, wherein the buffer element comprises an elongate buffer element body portion extending from a buffer element head portion, wherein the buffer element body portion includes an externally threaded portion; a collar nut, wherein a collar nut aperture is formed through the collar nut, wherein at least a portion of the collar nut aperture is internally threaded, wherein the internally threaded portion is threaded so as to interact with the externally threaded portion of the buffer element body portion; and a locking collar, wherein a locking collar aperture is formed through the locking collar, wherein the locking collar aperture is formed so as to accept at least a portion of the buffer element body portion therethrough.

In certain of these exemplary, nonlimiting embodiments, one or more collar nut recesses are formed in the collar nut, wherein one or more locking collar protrusions are formed in the locking collar, wherein the one or more locking collar protrusions are mateable with the one or more collar nut recesses, and wherein when the locking collar is abutted against the collar nut, interaction of mating locking collar recesses and locking collar protrusions maintain the locking collar in a rotational position relative to the collar nut.

Alternatively, in certain of these exemplary, nonlimiting embodiments, one or more collar nut recesses are formed in the locking collar, wherein one or more locking collar protrusions are formed in the collar nut, and wherein the one or more locking collar protrusions are mateable with the one or more collar nut recesses, and wherein when the locking collar is abutted against the collar nut, interaction of mating locking collar recesses and locking collar protrusions maintain the locking collar in a rotational position relative to the collar nut.

In various exemplary, nonlimiting embodiments of the present disclosure, the adjustable buffer optionally includes at least some of a buffer element, wherein the buffer element comprises an elongate buffer element body portion extending from a buffer element head portion, wherein the buffer element body portion includes an externally threaded portion; and a collar nut, wherein a collar nut aperture is formed through the collar nut, wherein at least a portion of the collar nut aperture is internally threaded, wherein the internally threaded portion is threaded so as to interact with the externally threaded portion of the buffer element body portion.

Accordingly, the presently disclosed systems, methods, and/or apparatuses provide an adjustable buffer that allows a user to adjust the preload of the buffer spring.

The presently disclosed systems, methods, and/or apparatuses optionally separately provide an adjustable buffer that allows a user to adjust the tension of the buffer spring.

The presently disclosed systems, methods, and/or apparatuses optionally separately provide an adjustable buffer that may optionally provide increased bolt lock time.

The presently disclosed systems, methods, and/or apparatuses optionally separately provide an adjustable buffer that reduces felt recoil.

The presently disclosed systems, methods, and/or apparatuses optionally separately provide an adjustable buffer that can be utilized in conjunction with a standard buffer spring.

The presently disclosed systems, methods, and/or apparatuses optionally separately provide an adjustable buffer that allows the recoil system to be "tuned".

The presently disclosed systems, methods, and/or apparatuses optionally separately provide an adjustable buffer that allows a user to "dial" the collar nut on the buffer element until a desired pressure to slow the bolt has been found.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of the systems, methods, and/or apparatuses that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the presently disclosed systems, methods, and/or apparatuses will be described in detail, with reference to the following figures, wherein like reference numerals refer to like parts throughout the several views, and wherein.

DETAILED DESCRIPTION OF THE INVENTION

Figure 1:
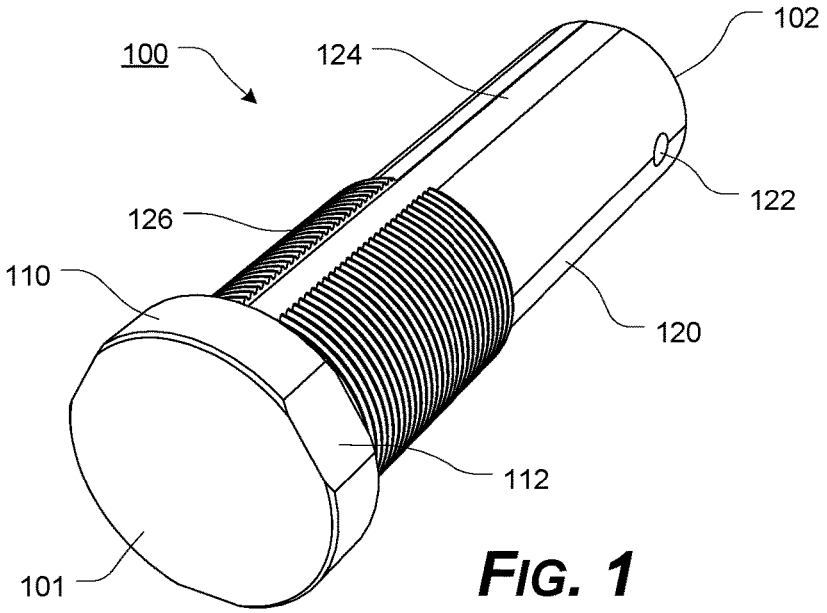
FIG. 1 illustrates an upper, front perspective view of an exemplary embodiment of a buffer element, according to the presently disclosed systems, methods, and/or apparatuses.
Figure 2:
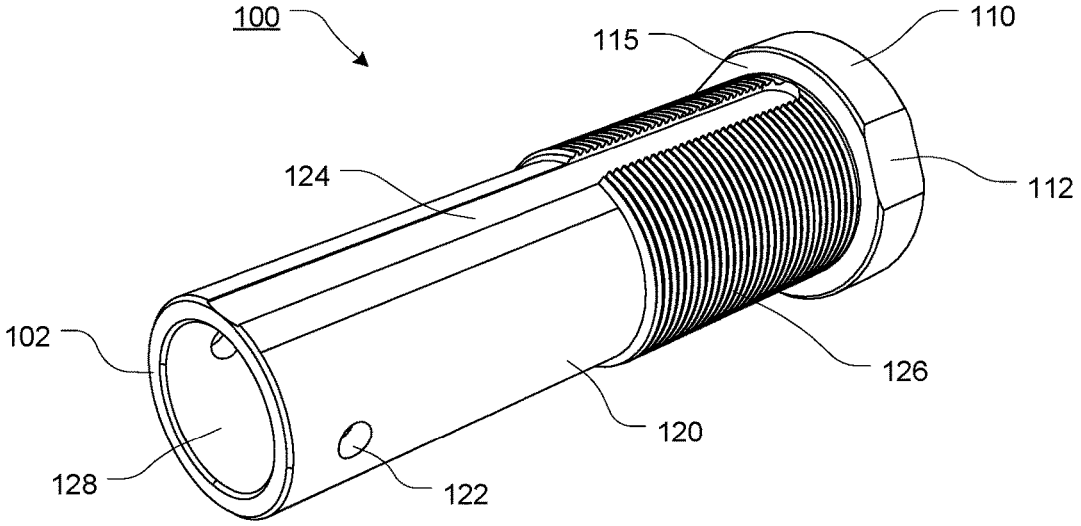
FIG. 2 illustrates an upper, rear perspective view of an exemplary embodiment of a buffer element, according to the presently disclosed systems, methods, and/or apparatuses.
Figure 3:
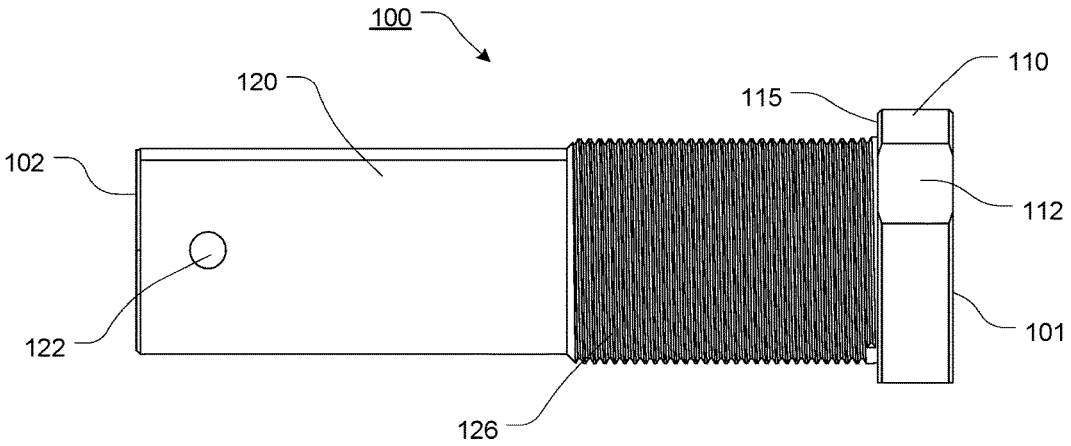
FIG. 3 illustrates a side view of an exemplary embodiment of a buffer element, according to the presently disclosed systems, methods, and/or apparatuses.
Figure 4:
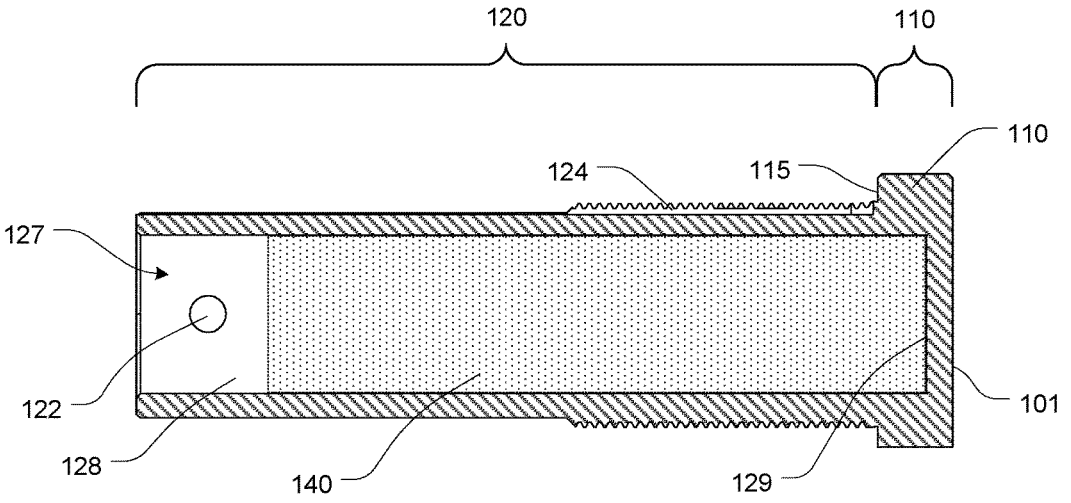
FIG. 4 illustrates a side cross-sectional view taken along line 4-4 of the compact buffer tube of FIG. 7, according to the presently disclosed systems, methods, and/or apparatuses.
Figure 5:
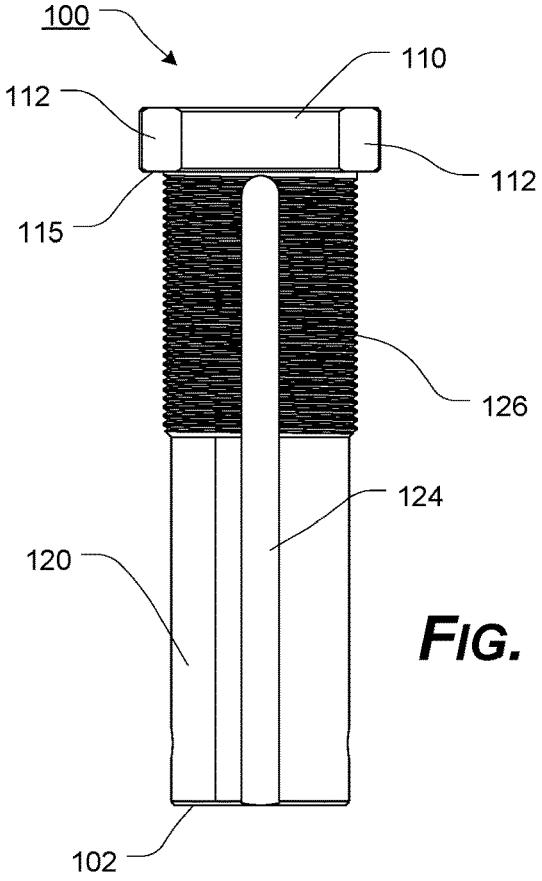
FIG. 5 illustrates a top view of an exemplary embodiment of a buffer element, according to the presently disclosed systems, methods, and/or apparatuses.
Figure 6:
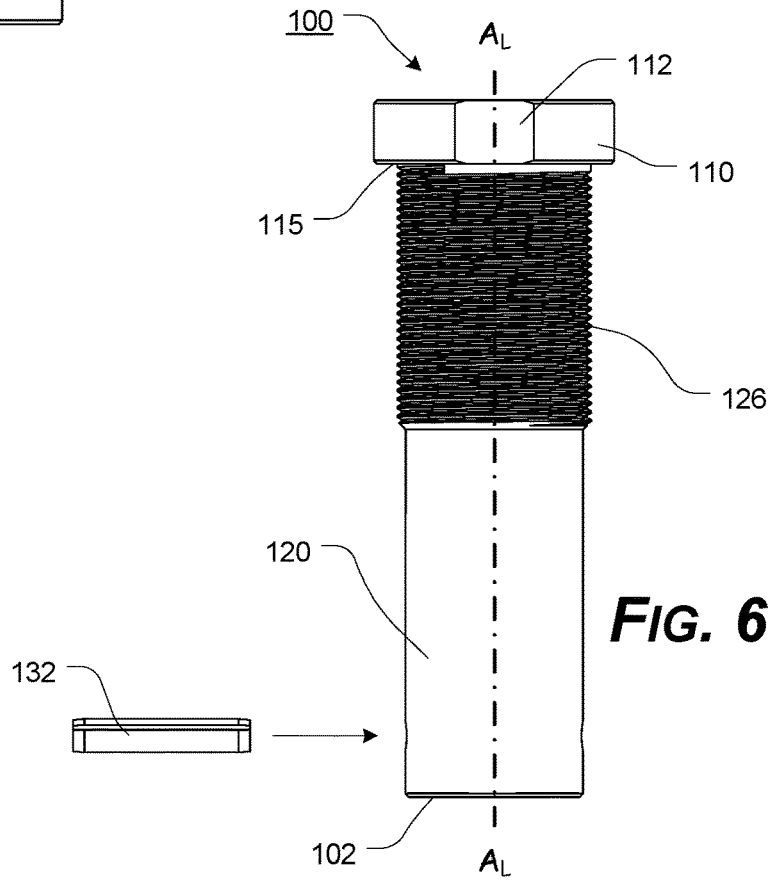
FIG. 6 illustrates a bottom view of an exemplary embodiment of a buffer element, according to the presently disclosed systems, methods, and/or apparatuses.
Figure 7:
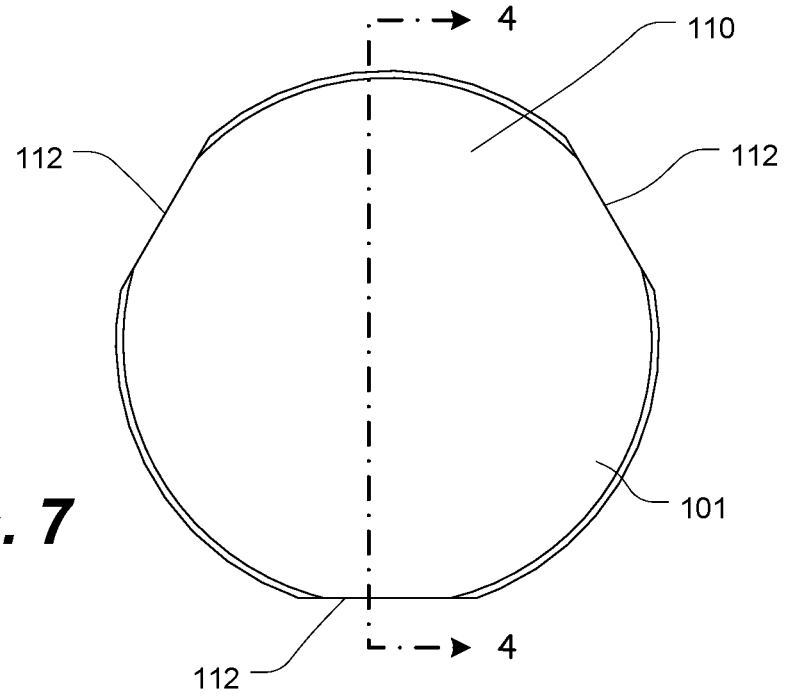
FIG. 7 illustrates a front view of an exemplary embodiment of a buffer element, according to the presently disclosed systems, methods, and/or apparatuses.
Figure 8:
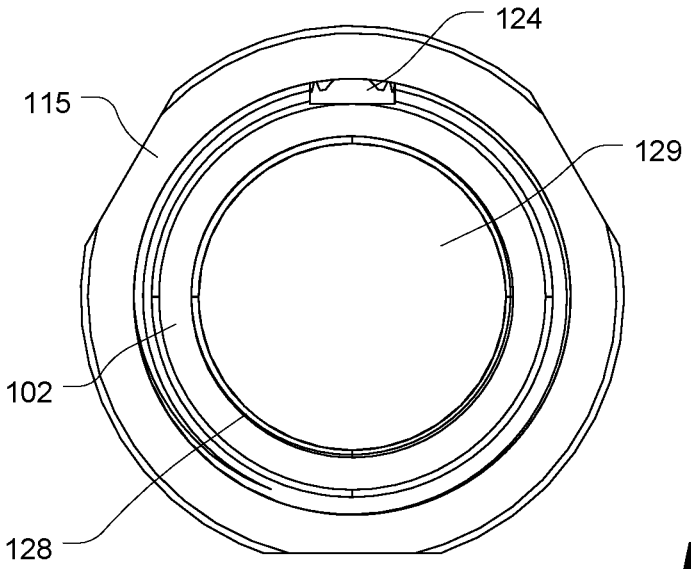
FIG. 8 illustrates a rear view of an exemplary embodiment of a buffer element, according to the presently disclosed systems, methods, and/or apparatuses.
Figure 9:
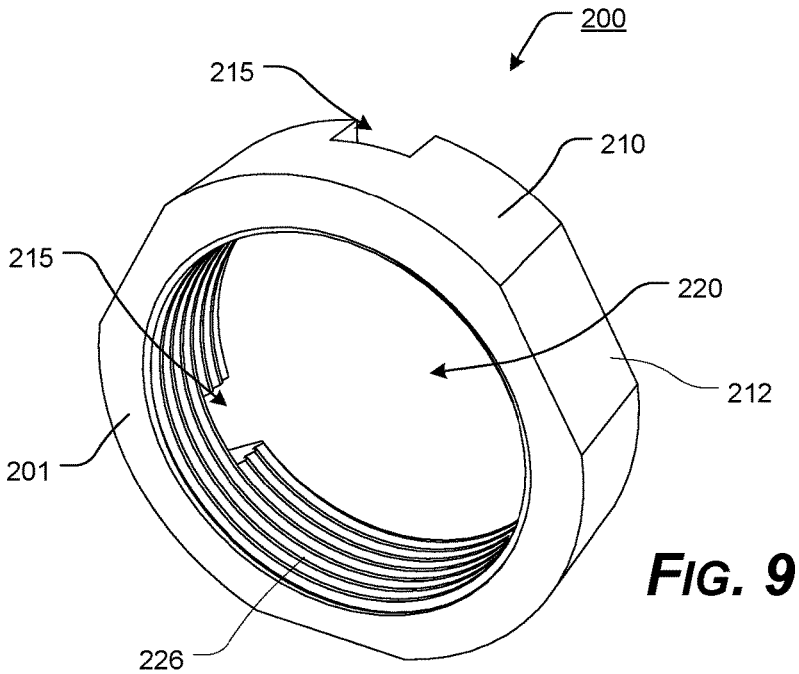
FIG. 9 illustrates an upper, front perspective view of an exemplary embodiment of a collar nut, according to the presently disclosed systems, methods, and/or apparatuses.
Figure 10:
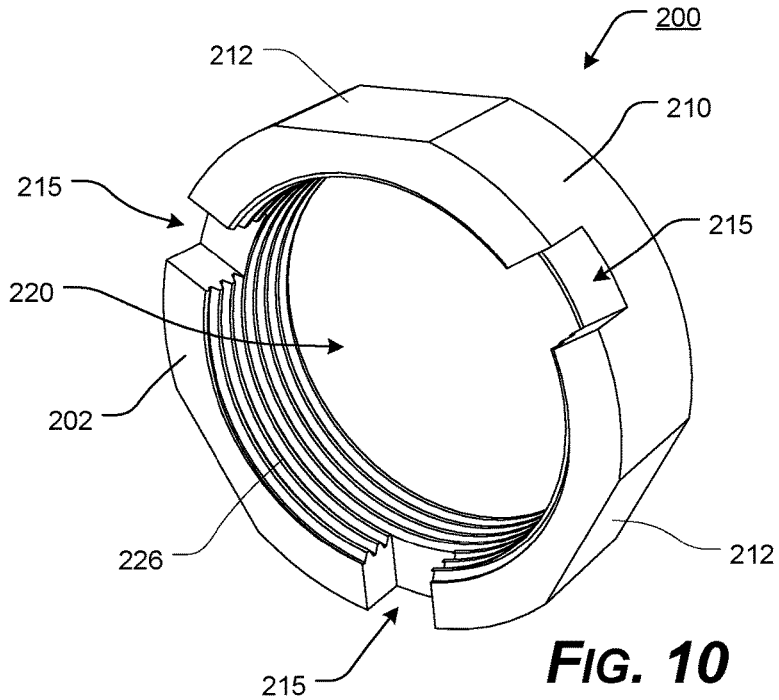
FIG. 10 illustrates an upper, rear perspective view of an exemplary embodiment of a collar nut, according to the presently disclosed systems, methods, and/or apparatuses.
Figure 11:
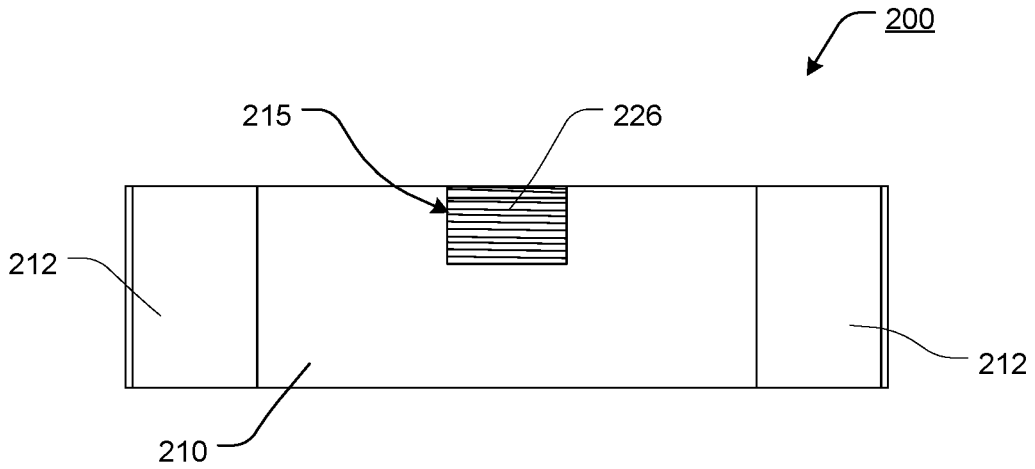
FIG. 11 illustrates a top view of an exemplary embodiment of a collar nut, according to the presently disclosed systems, methods, and/or apparatuses.
Figure 12:
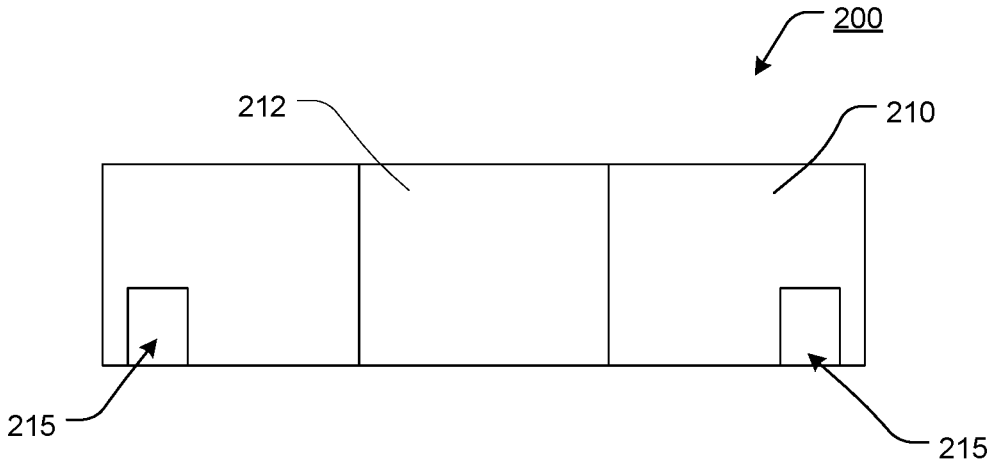
FIG. 12 illustrates a bottom view of an exemplary embodiment of a collar nut, according to the presently disclosed systems, methods, and/or apparatuses.
Figure 13:
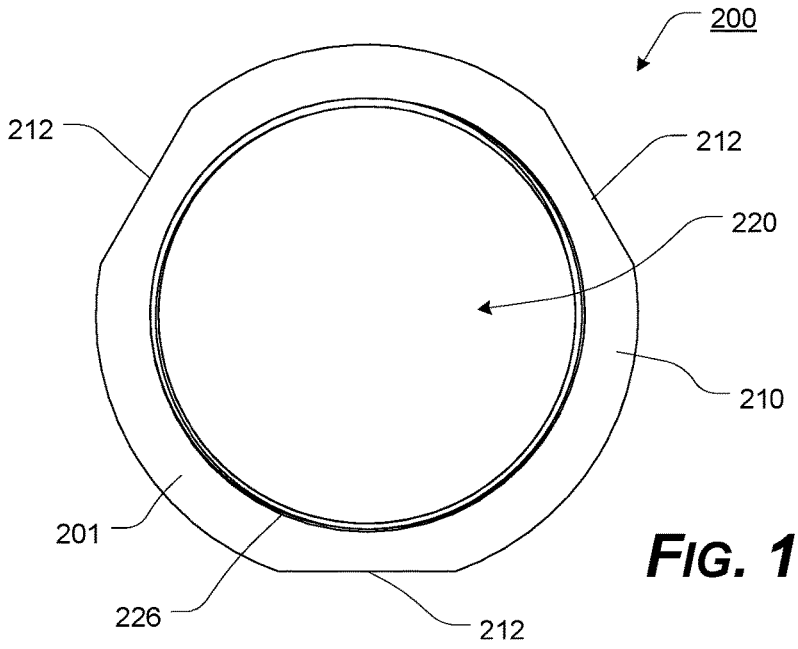
FIG. 13 illustrates a front view of an exemplary embodiment of a collar nut, according to the presently disclosed systems, methods, and/or apparatuses.
Figure 14:
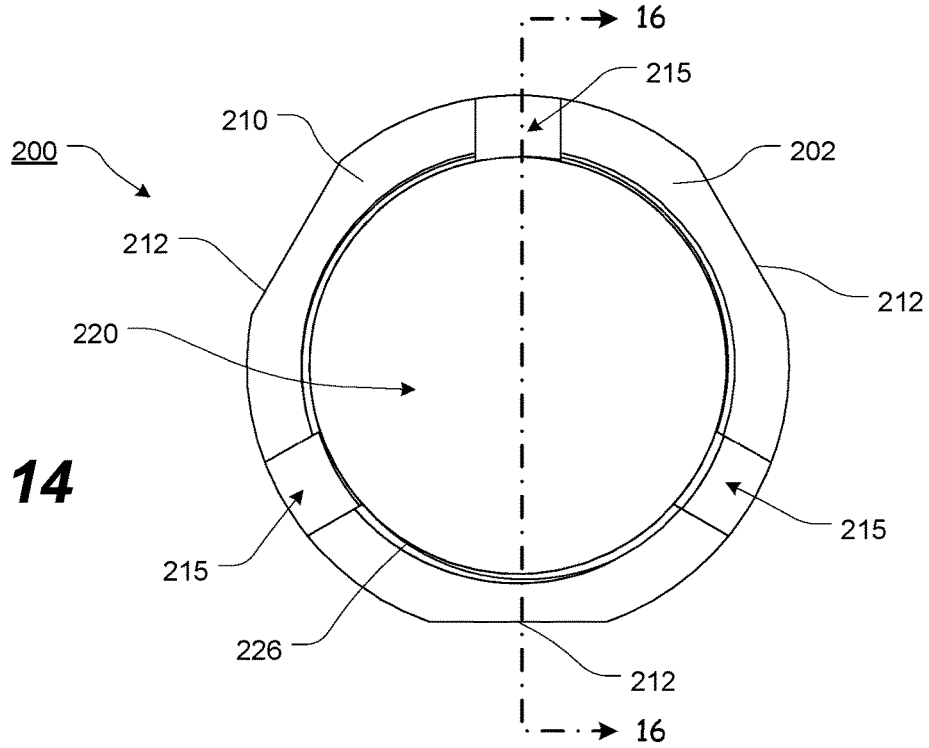
FIG. 14 illustrates a rear view of an exemplary embodiment of a collar nut, according to the presently disclosed systems, methods, and/or apparatuses.
Figure 15:
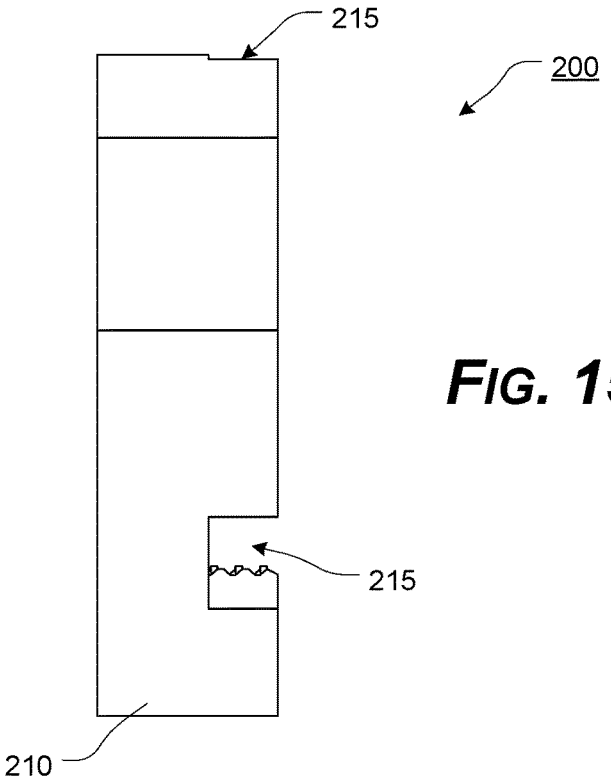
FIG. 15 illustrates a side view of an exemplary embodiment of a collar nut, according to the presently disclosed systems, methods, and/or apparatuses.
Figure 16:
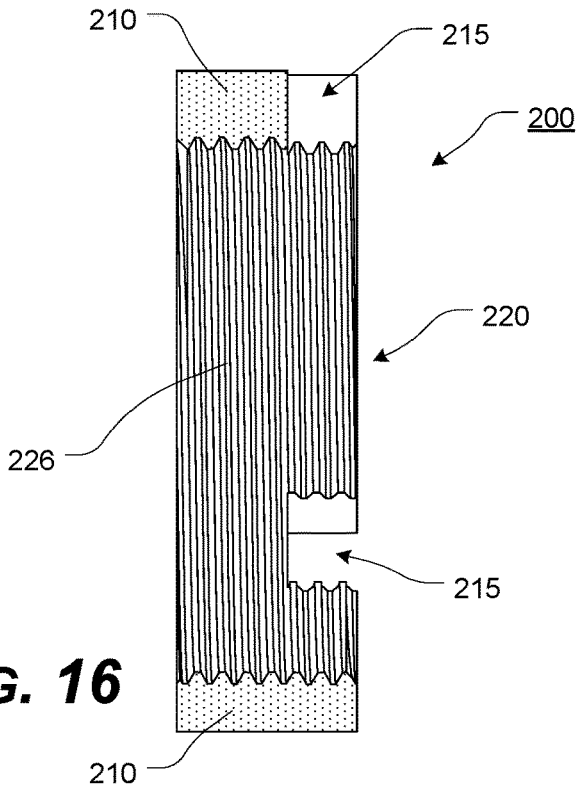
FIG. 16 illustrates a cross-sectional view taken along line 16-16 of the buffer element of FIG. 14, according to the presently disclosed systems, methods, and/or apparatuses.
Figure 17:
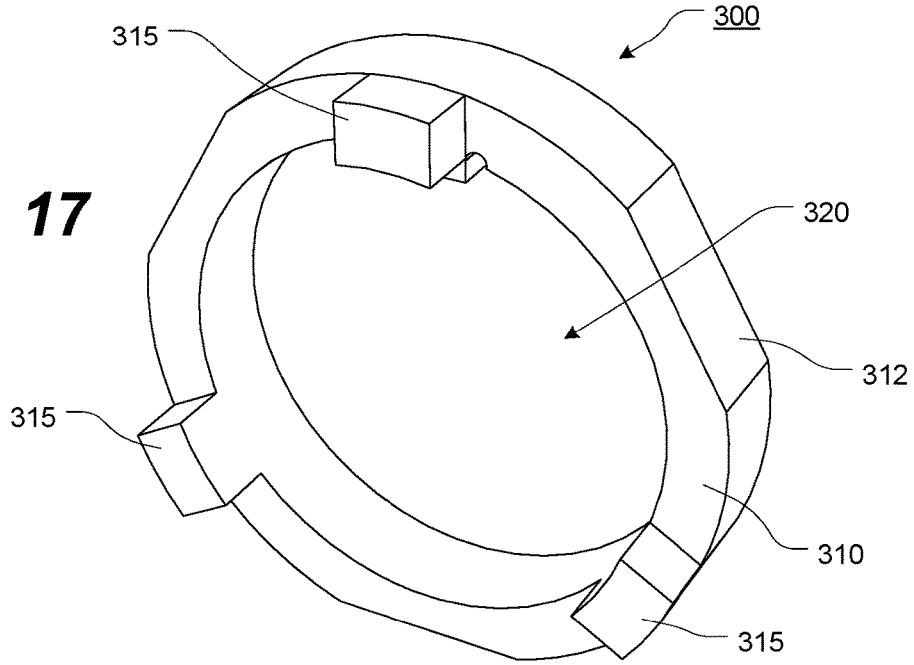
FIG. 17 illustrates an upper, front perspective view of an exemplary embodiment of a locking collar, according to the presently disclosed systems, methods, and/or apparatuses.
Figure 18:
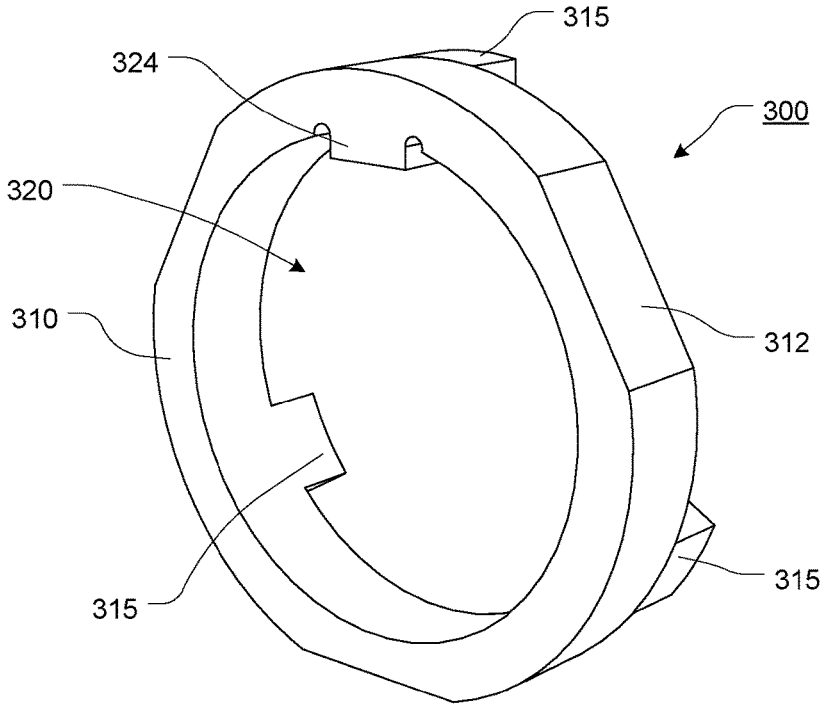
FIG. 18 illustrates an upper, rear perspective view of an exemplary embodiment of a locking collar, according to the presently disclosed systems, methods, and/or apparatuses.
Figure 19:
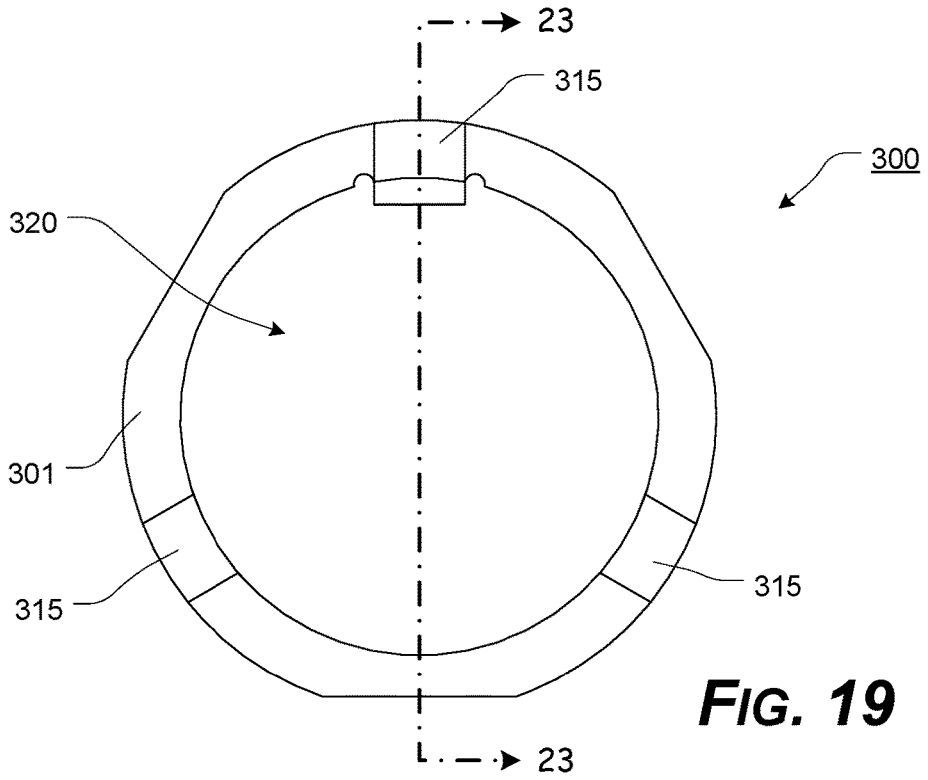
FIG. 19 illustrates a front view of an exemplary embodiment of a locking collar, according to the presently disclosed systems, methods, and/or apparatuses.
Figure 20:
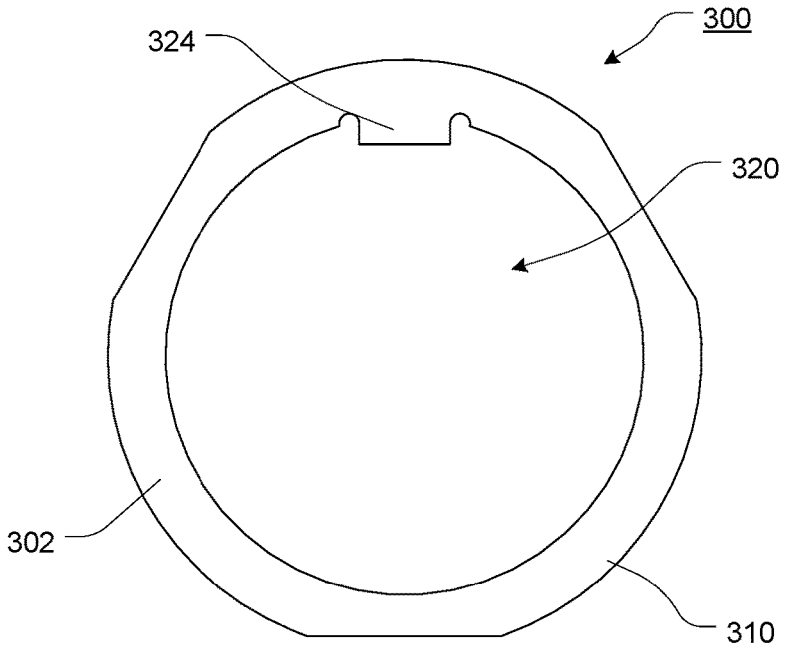
FIG. 20 illustrates a rear view of an exemplary embodiment of a locking collar, according to the presently disclosed systems, methods, and/or apparatuses.
Figure 21:
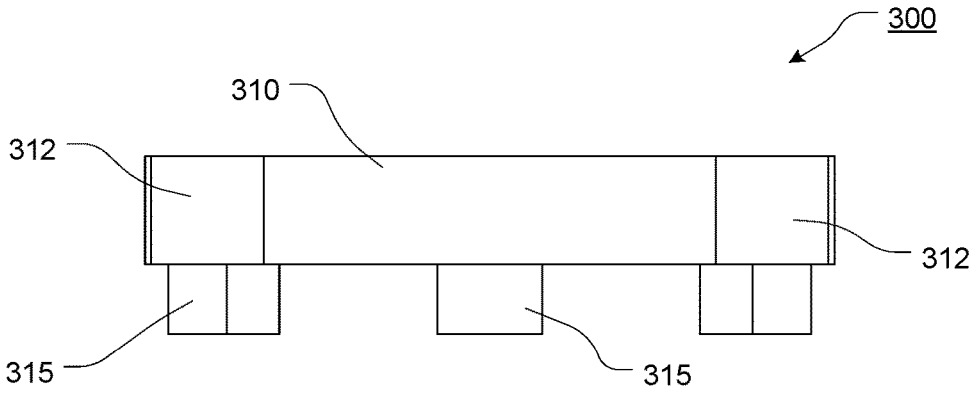
FIG. 21 illustrates a top view of an exemplary embodiment of a locking collar, according to the presently disclosed systems, methods, and/or apparatuses.
Figure 22:
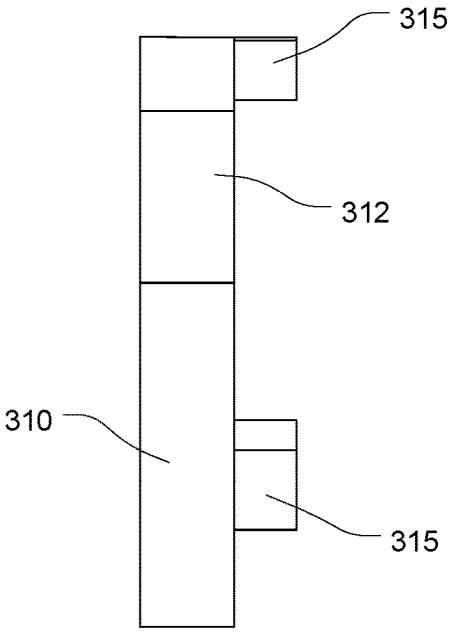
FIG. 22 illustrates a side view of an exemplary embodiment of a locking collar, according to the presently disclosed systems, methods, and/or apparatuses.
Figure 23:
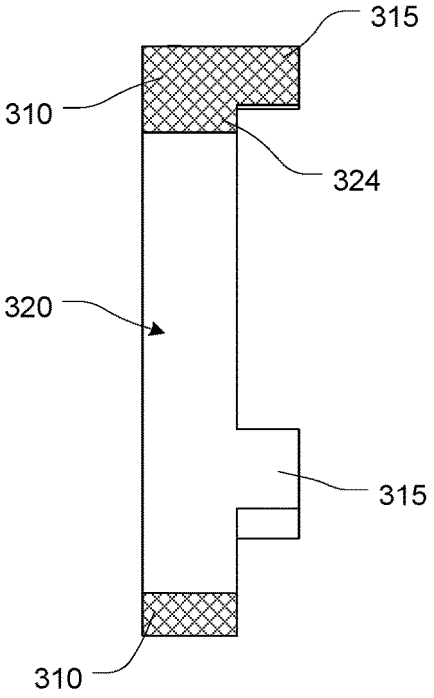
FIG. 23 illustrates a cross-sectional view taken along line 23-23 of the locking collar of FIG. 19, according to the presently disclosed systems, methods, and/or apparatuses.
Figure 24:
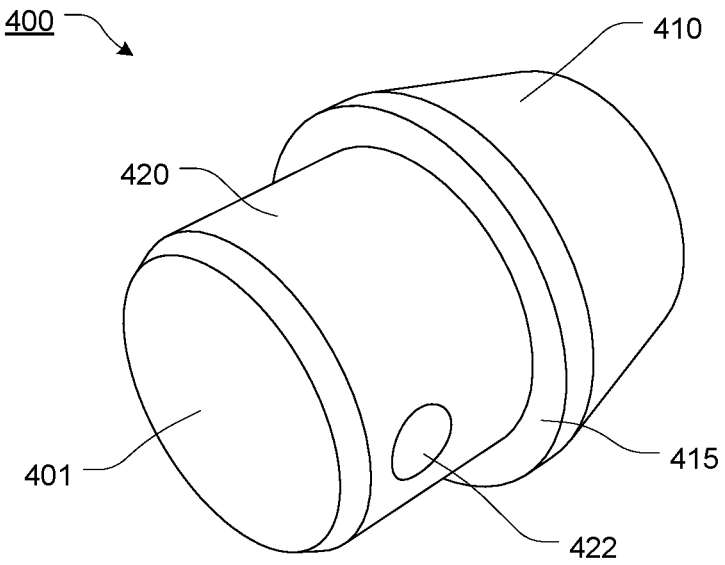
FIG. 24 illustrates an upper, front perspective view of an exemplary embodiment of an end cap, according to the presently disclosed systems, methods, and/or apparatuses.
Figure 25:
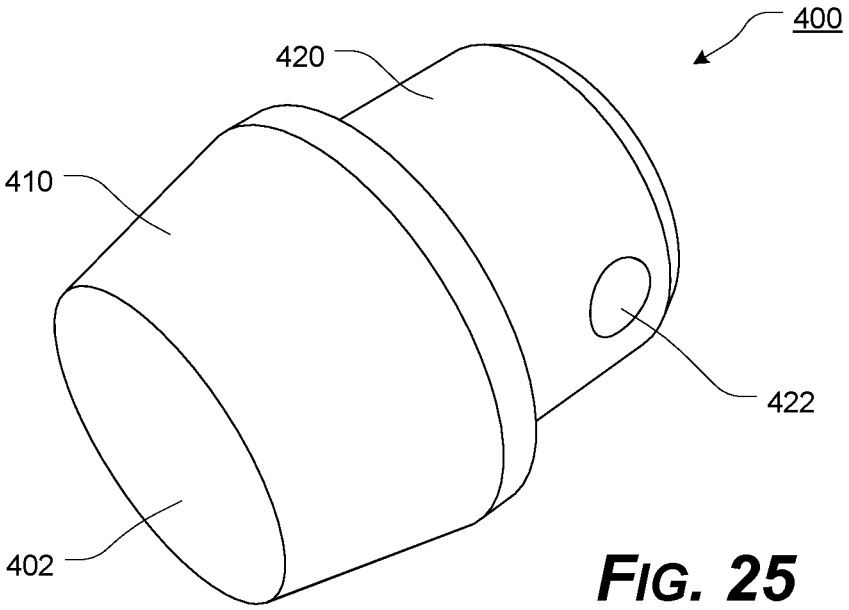
FIG. 25 illustrates an upper, rear perspective view of an exemplary embodiment of an end cap, according to the presently disclosed systems, methods, and/or apparatuses.
Figure 26:
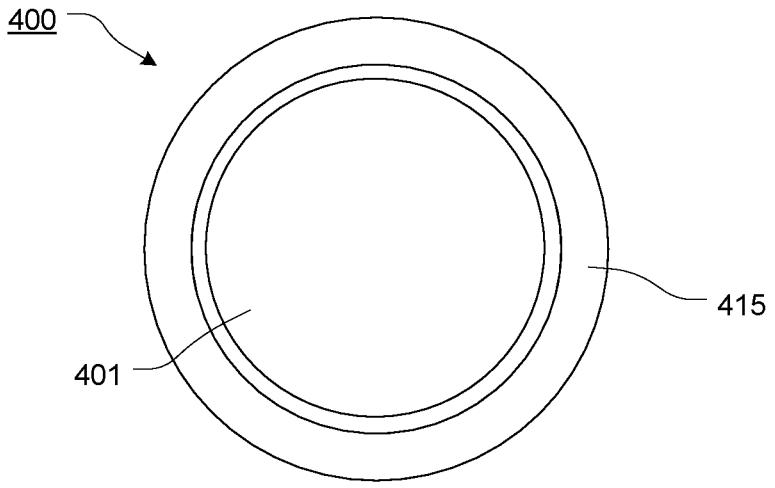
FIG. 26 illustrates a front view of an exemplary embodiment of an end cap, according to the presently disclosed systems, methods, and/or apparatuses.
Figure 27:
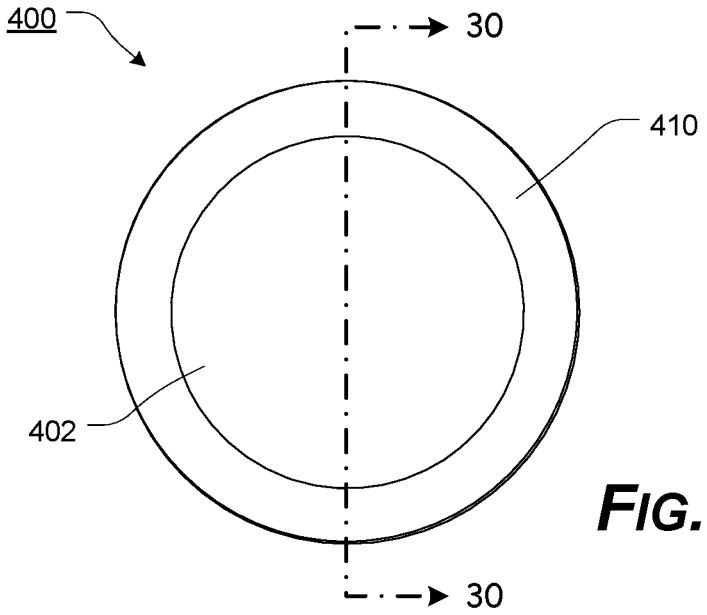
FIG. 27 illustrates a rear view of an exemplary embodiment of an end cap, according to the presently disclosed systems, methods, and/or apparatuses.
Figure 28:
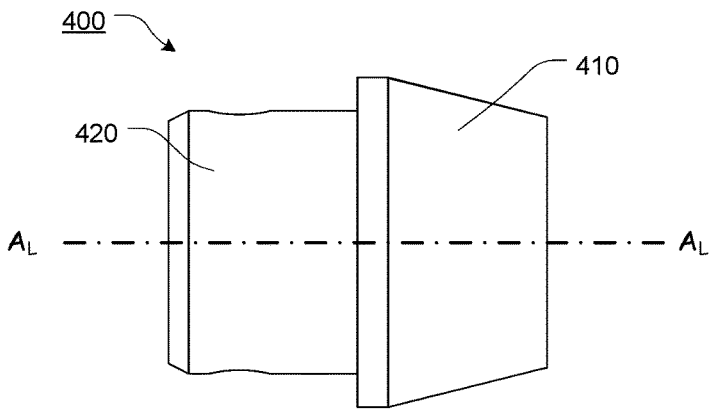
FIG. 28 illustrates a top view of an exemplary embodiment of an end cap, according to the presently disclosed systems, methods, and/or apparatuses.
Figure 29:
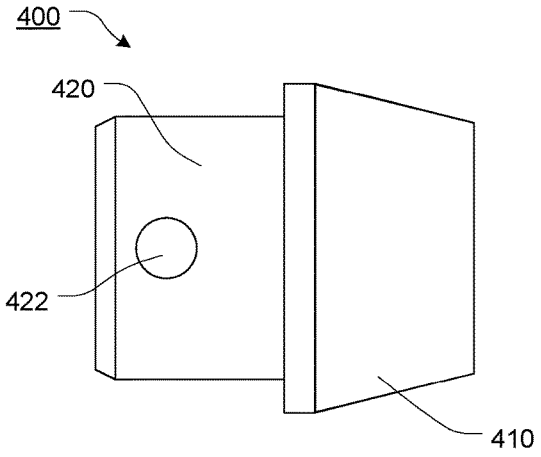
FIG. 29 illustrates a side view of an exemplary embodiment of an end cap, according to the presently disclosed systems, methods, and/or apparatuses.
Figure 30:
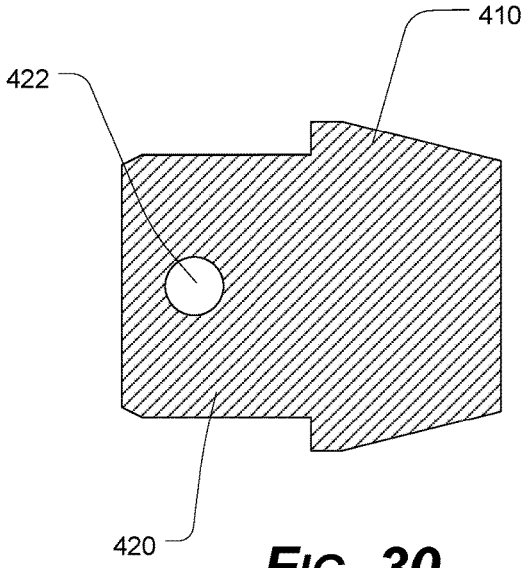
FIG. 30 illustrates a cross-sectional view taken along line 30-30 of the end cap of FIG. 27, according to the presently disclosed systems, methods, and/or apparatuses.
Figure 31:
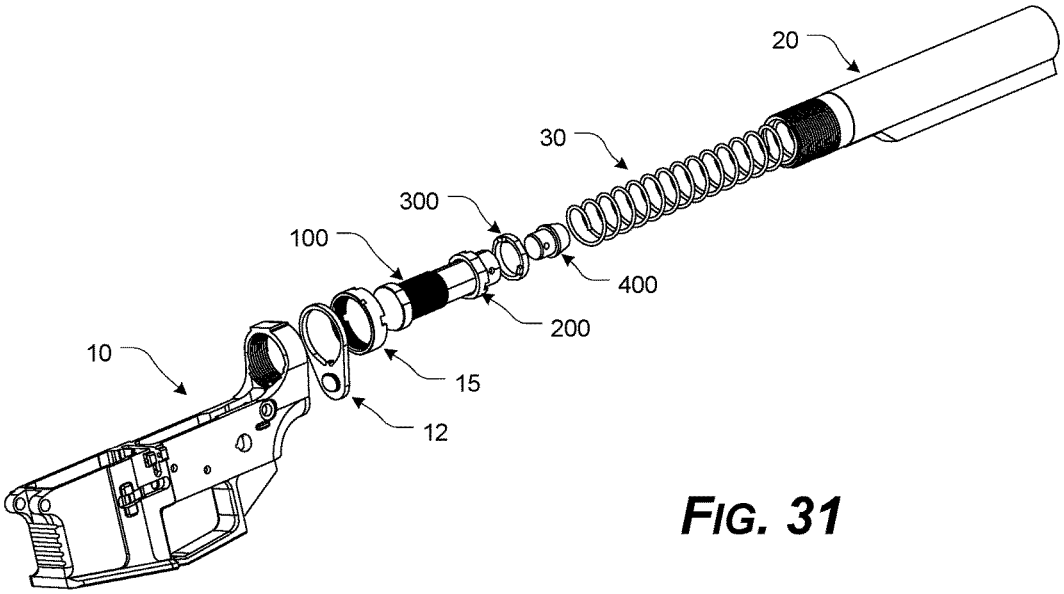
FIG. 31 illustrates an exploded, perspective view of an exemplary embodiment of the adjustable buffer utilized in conjunction with an upper receiver, end plate, recoil spring, and buffer tube, according to the presently disclosed systems, methods, and/or apparatuses.
Figure 32:
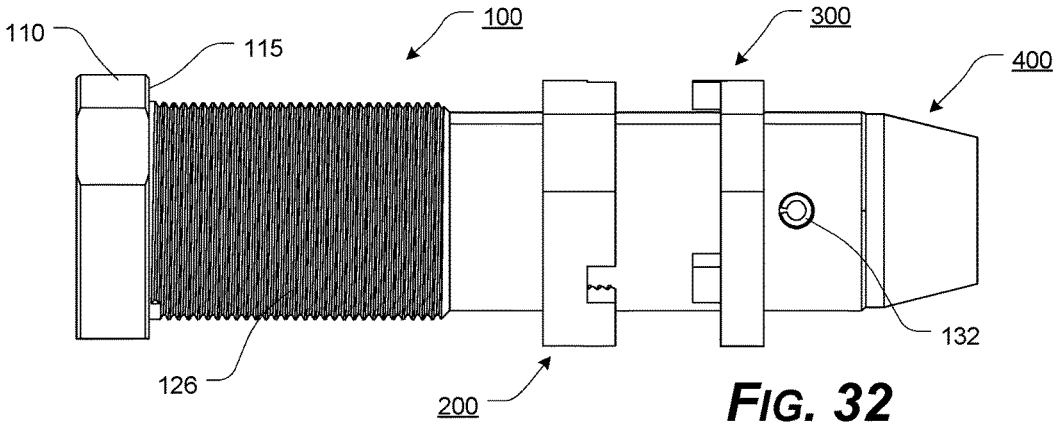
FIG. 32 illustrates a side view of an exemplary embodiment of the adjustable buffer element having an exemplary collar nut and locking collar being assembled together, according to the presently disclosed systems, methods, and/or apparatuses.
Figure 33:
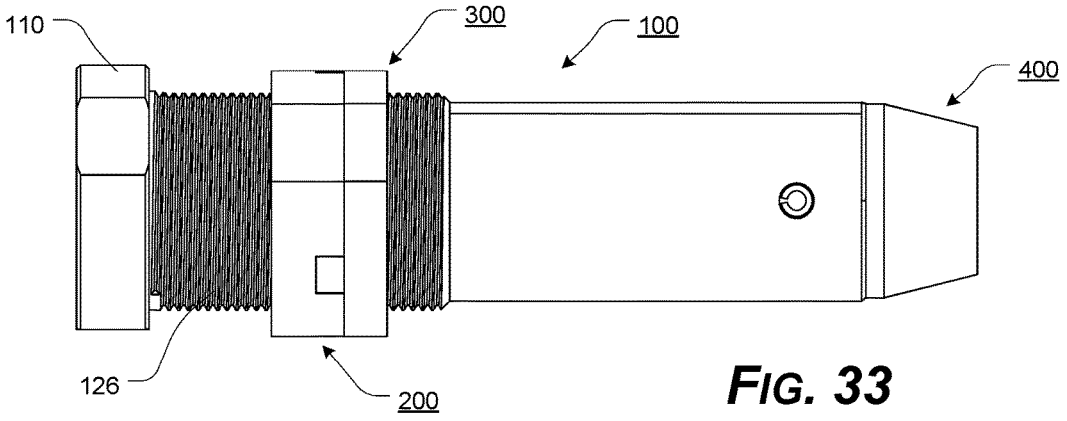
FIG. 33 illustrates a side view of an exemplary embodiment of the adjustable buffer element having an exemplary collar nut and locking collar in an exemplary, assembled position, according to the presently disclosed systems, methods, and/or apparatuses.
Figure 34:
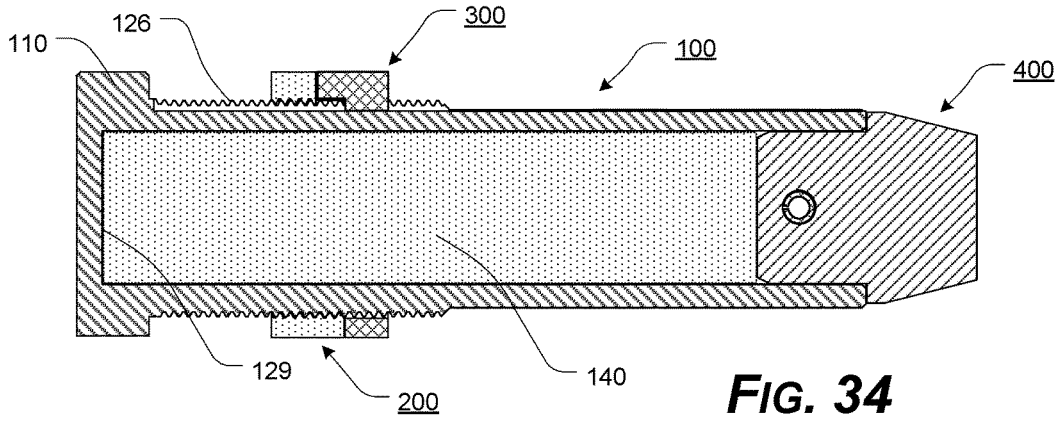
FIG. 34 illustrates a cross-sectional view of the adjustable buffer assembly of FIG. 33, according to the presently disclosed systems, methods, and/or apparatuses.

For simplicity and clarification, the design factors and operating principles of the adjustable buffer according to the presently disclosed systems, methods, and/or apparatuses are explained with reference to various exemplary embodiments of an adjustable buffer according to the presently disclosed systems, methods, and/or apparatuses. The basic explanation of the design factors and operating principles of the adjustable buffer is applicable for the understanding, design, and operation of the adjustable buffer of the presently disclosed systems, methods, and/or apparatuses. It should be appreciated that the adjustable buffer can be adapted to many applications where an adjustable buffer can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "adjustable buffer", "collar nut", "locking collar", and "firearm" are used for basic explanation and understanding of the operation of the presently disclosed systems, methods, and/or apparatuses. Therefore, the terms "adjustable buffer", "collar nut", "locking collar", and "firearm" are not to be construed as limiting the systems, methods, and/or apparatuses of the present disclosure. Thus, for example, the term "firearm" is to be understood to broadly include any firearm or other similar handheld or shoulder mounted device or tool.

For simplicity and clarification, the adjustable buffer of the present disclosure will be described as being used in conjunction with a firearm, such as an AR-15 or M4 style rifle or carbine. However, it should be appreciated that these are merely exemplary embodiments of the adjustable buffer and are not to be construed as limiting the presently disclosed systems, methods, and/or apparatuses. Thus, the adjustable buffer of the present disclosure may be utilized in conjunction with any firearm or rifle, such as, for example, an AR-10 style rifle, air rifle, paintball marker, Airsoft rifle, replica rifle, or any other tool, device, or object.

Turning now to the drawing FIGS., FIGS. 1-37 illustrate certain elements and/or aspects of an exemplary embodiment of the adjustable buffer, according to the presently disclosed systems, methods, and/or apparatuses. In illustrative, non-limiting embodiment(s) of the present disclosure, as illustrated in FIGS. 1-37, the adjustable buffer comprises at least some of a buffer element 100, an optional weight element 140, a collar nut 200, an optional locking collar 300, and an optional end cap 400.

As illustrated most clearly in FIGS. 1-8, the buffer element 100 comprises a buffer element body portion 120 and a buffer element head portion 110. The buffer element 100 comprises an elongate portion of material extending, along a longitudinal axis $A_L$, from a first end 101 to a second end 102 of the buffer element 100.

In various exemplary embodiments, the buffer element 100 includes a buffer element cavity 127 defined by one or more interior side walls 128 and an interior bottom wall 129. The buffer element cavity 127 extends from the interior bottom wall 129, along the one or more interior side walls 128, to an open end of the buffer element cavity 127.

In various exemplary, nonlimiting embodiments, the buffer element 100 is formed of a substantially solid portion of material and only includes a buffer element cavity 127 of a sufficient size to accept at least a portion of the end cap extension portion 420 of the end cap 400. Alternatively, the buffer element cavity 127 may not be included and the end cap 400 is not a separate element, but is formed as an integral part of the buffer element 100.

The buffer element body portion 120 extends from the second end 102 of the buffer element 100 to a buffer element shoulder 115. In various exemplary embodiments, the buffer element body portion 120 extends parallel to the longitudinal axis $A_L$, of the buffer element 100 and the buffer element shoulder 115 extends perpendicular to the longitudinal axis $A_L$, of the buffer element 100. Alternatively, the buffer element shoulder 115 may extend at an angle that is equal to, greater than, or less than 90° relative to the longitudinal axis $A_L$, of the buffer element 100.

A bulbous portion or buffer element head portion 110 extends from the buffer element shoulder 115 to the front end or front surface of the buffer element 100. The buffer element head portion 110 has a greater outer diameter than an outer diameter of the buffer element body portion 120.

In certain exemplary embodiments, one or more recesses or notches 112 are formed around portions of the buffer element head portion 110. If included, the recesses or notches 112 provide debris channels, such that any matter or debris that comes between the buffer element head portion 110 and the buffer tube 20 can be diverted into the recesses or notches 112, so as not to hinder the movement of the buffer element 100 in relation to the buffer tube 20.

A threaded portion 126 extends along at least a portion of the buffer element body portion 120 between the buffer element shoulder 115 and the second end 102 of the buffer element body portion 120.

An alignment groove 124 may optionally be formed in at least a portion of the buffer element body portion 120, extending from the second end 102 toward (and optionally to) the buffer element shoulder 115.

In various exemplary embodiments, wherein the end cap 400 is included, a buffer element retaining pin aperture 122 extends at least partially through the buffer element body portion 120, proximate the second end 102 of the buffer element 100 and is formed so as to accept at least a portion of a retaining pin 132 therethrough.

In various exemplary embodiments, the buffer element 100 is substantially rigid and is formed of stainless steel. Alternate materials of construction of the buffer element 100 may include one or more of the following: steel, aluminum, titanium, and/or other metals, as well as various alloys and composites thereof. Thus, it should be understood that the material or materials used to form the buffer element 100 is a design choice based on the desired appearance and/or functionality of the buffer element 100.

If included, the weight element 140 is sized so as to be fitted within the buffer element cavity 127 of the buffer element 100. The actual weight of the weight element 140 can vary, depending upon the desired functionality of the weight element 140 and the overall functional weight of the buffer element 100. In various exemplary embodiments, the weight element 140 may comprise a portion of stainless steel or tungsten. Alternatively, the weight element 140 may comprise a solid portion of material, a powdered or granulated material (such as, for example, loose sand, lead, steel, or other metallic or nonmetallic shot), or a liquid (such as, for example, Mercury).

As illustrated most clearly in FIGS. 24-30, the end cap 400 comprises a portion of material extending, along a longitudinal axis $A_L$, from a first end 401 of the end cap 400 to a second end of the end cap 400. In various exemplary embodiments, an end cap extension portion 420 of the end cap 400 extends rearward from the first end 401 of the end cap 400. The end cap extension portion 420 of the end cap 400 extends from the first end 401 of the end cap 400 to an end cap shoulder 415. In various exemplary embodiments, the end cap extension portion 420 of the end cap 400 extends parallel to the longitudinal axis $A_L$, of the end cap 400 and the end cap shoulder 415 extends perpendicular to the longitudinal axis $A_L$, of the end cap 400. Alternatively, the end cap shoulder 415 may extend at an angle that is equal to, greater than, or less than 90° relative to the longitudinal axis $A_L$, of the end cap 400.

The outer size and shape of the end cap extension portion 420 of the end cap 400 is such that at least a portion of the end cap extension portion 420 of the end cap 400 can be fitted through the open end of the buffer element cavity 127 of the buffer element cavity 127 and positioned within at least a portion of the buffer element cavity 127.

An end cap head portion 410 extends rearward from the end cap shoulder 415 to the second end of the end cap 400. In various exemplary embodiments, the end cap head portion 410 has an overall dome or a tapered shape. Alternatively, the end cap head portion 410 may comprise a generally cylindrical overall shape.

An end cap retaining aperture 422 extends at least partially through the end cap extension portion 420 of the end cap 400 and is formed so as to accept at least a portion of a retaining pin 132 therethrough.

In various exemplary embodiments, the end cap 400 is substantially rigid and is formed of urethane. Alternatively, the end cap 400 may be substantially deformable or flexible and may be formed of rubber, silicone, plastic, self-lubricating plastic, or a polymeric material. Thus, it should be understood that the material or materials used to form the end cap 400 is a design choice based on the desired appearance and/or functionality of the end cap 400.

As illustrated most clearly in FIGS. 9-16, the collar nut 200 comprises a portion of material extending, along a longitudinal axis $A_L$, from a first end 201 of the collar nut 200 to a second end 202, to form a collar nut body 210. A collar nut aperture 220 is formed through the collar nut 200, along the longitudinal axis $A_L$.

At least a portion of the collar nut aperture 220 is internally threaded. The internally threaded portion 226 includes threads that correspond to the externally threaded portion 126 of the buffer element body portion 120. As illustrated most clearly in FIG. 32-34, the collar nut 200 may be threadedly connected to the buffer element body portion 120, via interaction of an externally threaded portion 126 of the buffer element body portion 120 and the internally threaded portion 226 of the collar nut 200.

Thus, by rotating the collar nut 200 relative to the buffer element 100, the position of the collar nut 200 along the buffer element body portion 120 can be adjusted by interaction of the externally threaded portion 126 of the buffer element body portion 120 and the internally threaded portion of the collar nut 200.

One or more locking collar recesses 215 are formed in the collar nut 200. The number, shape, and placement of each locking collar 300 recess 215 is a design choice.

In certain exemplary embodiments, one or more recesses or notches 212 are formed around portions of the collar nut 200. If included, the recesses or notches 212 provide debris channels, such that any matter or debris that comes between the collar nut 200 and the buffer tube 20 can be diverted into the recesses or notches 212, so as not to hinder the movement of the collar nut 200 (or buffer element 100) in relation to the buffer tube 20.

In various exemplary embodiments, the collar nut 200 is substantially rigid and is formed of aluminum. Alternate materials of construction of the collar nut 200 may include one or more of the following: steel, stainless steel, titanium, and/or other metals, as well as various alloys and composites thereof. Thus, it should be understood that the material or materials used to form the collar nut 200 is a design choice based on the desired appearance and/or functionality of the collar nut 200.

As illustrated most clearly in FIGS. 17-23, the locking collar 300, if included, comprises a portion of material extending, along a longitudinal axis $A_L$, from a first end 301 of the locking collar 300 to a second end 302 of the locking collar 300. A locking collar aperture 320 is formed through the locking collar 300, along the longitudinal axis $A_L$. The locking collar aperture 320 is sized so as to accept at least a portion of the buffer element body portion 120 therethrough and to be repeatably slidable along at least a portion of the buffer element body portion 120.

In various exemplary embodiments, an alignment protrusion 324 extends into at least a portion of the locking collar aperture 320. If included, the alignment protrusion 324 is formed so as to be aligned with and slidable along the alignment groove 124 of the buffer element 100, when the locking collar 300 is positioned about the buffer element body portion 120 of the buffer element 100. Interaction of the alignment groove 124 and the alignment protrusion 324 maintains the locking collar 300 in a desired rotational position relative to the body element.

One or more locking collar protrusions 315 extend from the locking collar 300. The number, shape, and placement of each color protrusion is a design choice. One or more of the locking collar protrusions 315 is formed so as to be at least partially received within a corresponding locking collar 300 recess 215. Thus, when the first end 301 of the locking collar 300 is abutted against the second end 202 of the collar nut 200, the interaction of mating locking collar recesses 215 and locking collar protrusions 315 maintain the locking collar 300 in a desired rotational position relative to the collar nut 200.

Figure 38:
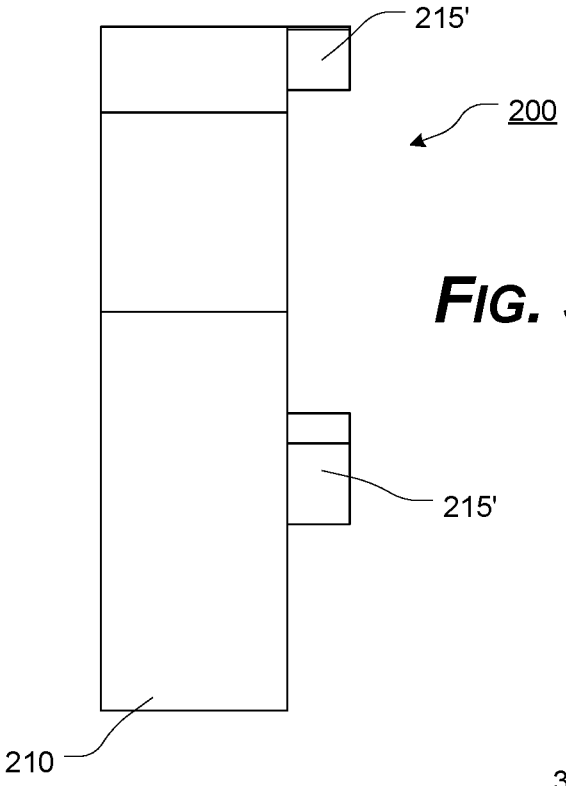
FIG. 38 illustrates a side view of an exemplary embodiment of an exemplary collar nut, according to the presently disclosed systems, methods, and/or apparatuses.
Figure 39:
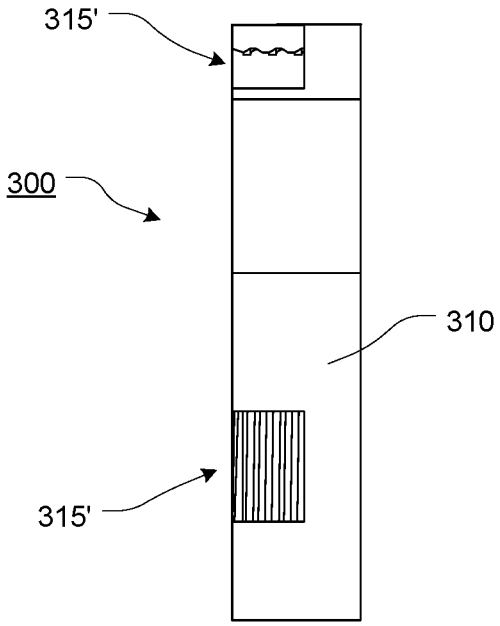
FIG. 39 illustrates a side way view of an exemplary embodiment of an exemplary locking collar, according to the presently disclosed systems, methods, and/or apparatuses.

In relation to various exemplary embodiments, it is shown and described that the locking collar protrusions 315 are formed on the locking collar 300 and the locking collar recesses 215 are formed on the collar nut 200, this is optional. However, as illustrated most clearly in FIGS. 38-39, the collar nut 200 may include locking collar protrusions 215' that extend from the collar nut 200 and mating locking collar recesses 315' may be formed in the locking collar 300.

In certain exemplary embodiments, one or more recesses or notches 312 are formed around portions of the locking collar 300. If included, the recesses or notches 312 provide debris channels, such that any matter or debris that comes between the locking collar 300 and the buffer tube 20 can be diverted into the recesses or notches 312, so as not to hinder the movement of the locking collar 300 (or buffer element 100) in relation to the buffer tube 20.

In various exemplary embodiments, the locking collar 300 is substantially rigid and is formed of aluminum. Alternate materials of construction of the locking collar 300 may include one or more of the following: steel, stainless steel, titanium, and/or other metals, as well as various alloys and composites thereof. Thus, it should be understood that the material or materials used to form the locking collar 300 is a design choice based on the desired appearance and/or functionality of the locking collar 300.

As illustrated most clearly in FIGS. 31-37, the various components of the adjustable buffer are fitted together and an exemplary buffer tube 20 is attached or coupled to an exemplary lower receiver 10. As illustrated, during assembly, the buffer spring 30 is inserted within the internal cavity of the buffer tube 20. The buffer spring 30 is inserted within the internal cavity of the buffer tube 20 such that the second end of the buffer spring 30 is in contact with the bottom wall of the internal cavity of the buffer tube 20.

If included, the weight element 140 is inserted within the buffer element cavity 127.

If the end cap 400 is included, at least a portion of the end cap extension portion 420 of the end cap 400 is fitted within the internal buffer cavity, such that the end cap retaining aperture 422 is aligned with the buffer element retaining pin aperture 122. In this configuration, the end cap shoulder 415 optionally contacts the second end 102 of the buffer element 100.

Once the end cap 400 is appropriately positioned proximate the second end 102 of the buffer element 100, the retaining pin 132 is positioned through the end cap retaining aperture 422, the buffer element retaining pin aperture 122.

The collar nut 200 is threadedly fitted about the buffer element body portion 120, via interaction of the internally threaded portion 226 of the collar nut 200 and the externally threaded portion 126 of the buffer element body portion 120.

The locking collar 300 is slidably fitted about the buffer element body portion 120, via interaction of the buffer element body portion 120 and the central locking collar aperture 320 (and optionally interaction of the alignment groove 124 of the buffer element 100 and the alignment protrusion 324 of the locking collar 300). The locking collar 300 is slidably fitted about the buffer element body portion 120 such that the second end of the locking collar 300 is abutted against the first end 201 of the collar nut 200 and the locking collar protrusions 315 are appropriately aligned with an at least partially fitted within the corresponding locking collar recesses 215.

Once the relevant components are attached or coupled to the buffer element 100, at least a portion of the buffer element body portion 120 of the assembled adjustable buffer is positionable within the buffer spring 30 such that the first end of the buffer spring 30 engages or contacts the second end of the locking collar body 310.

Figure 35:
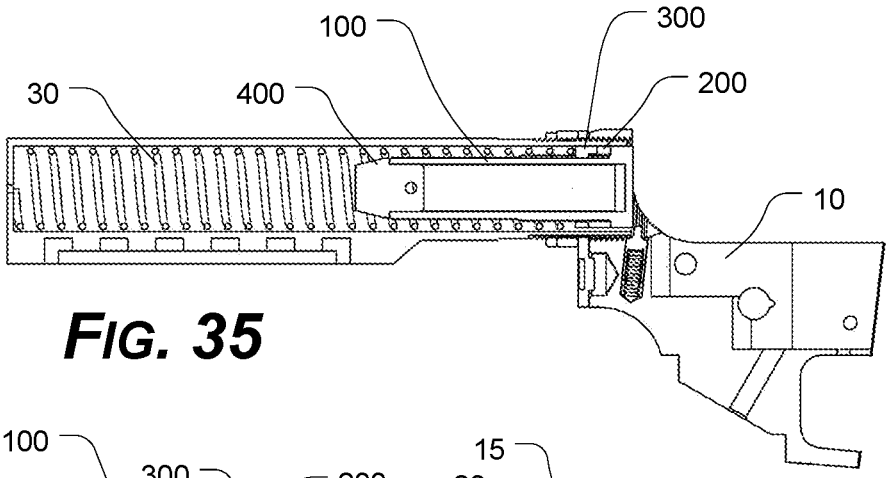
FIG. 35 illustrates a side, cutaway view of an exemplary embodiment of the adjustable buffer utilized in conjunction with an upper receiver, end plate, recoil spring, and buffer tube, according to the presently disclosed systems, methods, and/or apparatuses.
Figure 36:
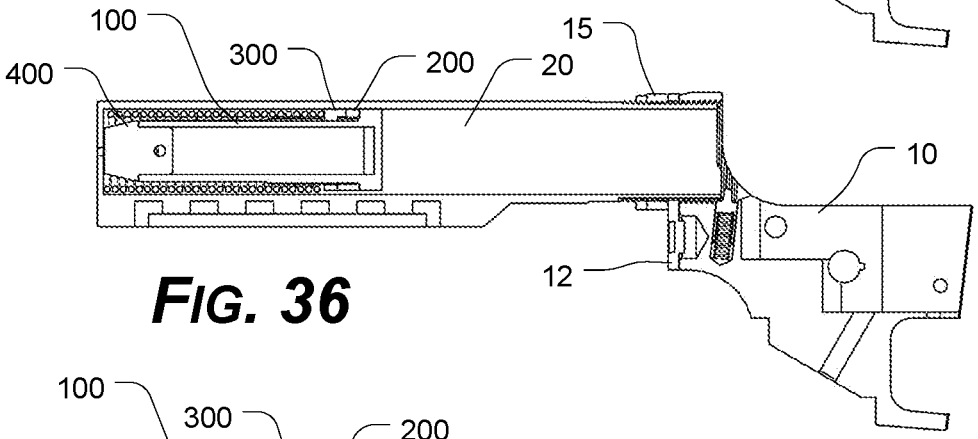
FIG. 36 illustrates a side, cutaway view of an exemplary embodiment of the adjustable buffer utilized in conjunction with an upper receiver, end plate, recoil spring, and buffer tube, according to the presently disclosed systems, methods, and/or apparatuses.
Figure 37:
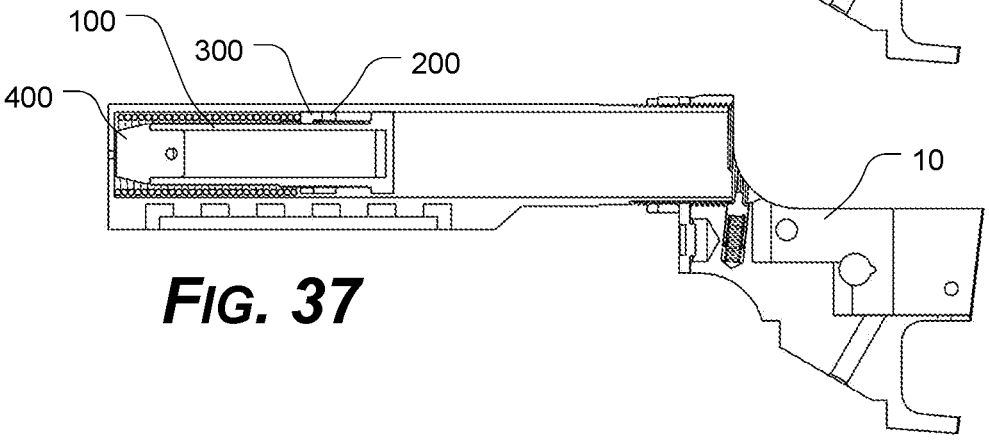
FIG. 37 illustrates a side, cutaway view of an exemplary embodiment of the adjustable buffer utilized in conjunction with an upper receiver, end plate, recoil spring, and buffer tube, according to the presently disclosed systems, methods, and/or apparatuses.

During a firing cycle, as illustrated most clearly in FIG. 35-37, as the bolt carrier is driven rearward, the rear of the bolt carrier contacts the first end 101 of the buffer element 100 (buffer element head portion 110) and urges the buffer element 100 rearward, toward the bottom wall of the buffer tube 20. The rearward force exerted on the buffer element 100 urges the buffer element 100 rearward, within the interior cavity of the buffer tube 20.

As illustrated most clearly in FIG. 36-37, the position of the locking collar 300 and collar nut 200 relative to the buffer element body portion 120 determines the amount of compression of the buffer spring 30 when the buffer element 100 "bottoms out" within the buffer tube 20. Thus, the position of the locking collar 300 and collar nut 200 relative to the buffer element body portion 120 can be used to limit the full compression of the buffer spring 30.

As illustrated in FIGS. 31-37, the adjustable buffer is illustrated as being utilized in conjunction with an exemplary lower receiver 10, end plate 12, castle nut 15, buffer spring 30, and buffer tube 20. It should be appreciated that these elements can be any known or later developed firearm elements. It should also be appreciated that a more detailed explanation of the lower receiver 10, the standard features and elements of a receiver that are not related to the present disclosure, instructions regarding how to assemble the lower receiver 10, and certain other items and/or techniques necessary for the implementation and/or operation of the various exemplary embodiments of the present disclosure are not provided herein because such elements are commercially available and/or such background information will be known to one of ordinary skill in the art. Therefore, it is believed that the level of description provided herein is sufficient to enable one of ordinary skill in the art to understand and practice the present disclosure, as described.

While the presently disclosed systems, methods, and/or apparatuses have been described in conjunction with the exemplary embodiments outlined above, the foregoing description of exemplary embodiments of the present disclosure, as set forth above, are intended to be illustrative, not limiting and the fundamental systems, methods, and/or apparatuses should not be considered to be necessarily so constrained. It is evident that the systems, methods, and/or apparatuses are not limited to the particular variation or variations set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the presently disclosed systems, methods, and/or apparatuses. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the presently disclosed systems, methods, and/or apparatuses belong.

In addition, it is contemplated that any optional feature of the inventive variations described herein may be set forth and claimed independently, or in combination with any one or more of the features described herein.

Accordingly, the foregoing description of exemplary embodiments will reveal the general nature of the presently disclosed systems, methods, and/or apparatuses, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the presently disclosed systems, methods, and/or apparatuses.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. An adjustable buffer, comprising:

a buffer element, wherein said buffer element comprises an elongate buffer element body portion extending from a buffer element head portion, wherein said buffer element body portion includes an externally threaded portion;

a collar nut, wherein a collar nut aperture is formed through said collar nut, wherein at least a portion of said collar nut aperture is internally threaded, wherein said internally threaded portion is threaded so as to interact with said externally threaded portion of said buffer element body portion, and wherein one or more collar nut recesses are formed in said collar nut; and a locking collar, wherein a locking collar aperture is formed through said locking collar, wherein said locking collar aperture is formed so as to accept at least a portion of said buffer element body portion therethrough, wherein said locking collar includes one or more locking collar protrusions, and wherein said one or more locking collar protrusions are mateable with said one or more collar nut recesses.

2. The adjustable buffer of claim 1, wherein said buffer element comprises an internal buffer element cavity defined by an open end, one or more side walls, and a bottom wall.

3. The adjustable buffer of claim 2, wherein a weight element is positioned within said internal buffer element cavity.

4. The adjustable buffer of claim 3, wherein said weight element comprises a solid portion of material, a powdered or granulated material, or a liquid.

5. The adjustable buffer of claim 1, wherein an alignment groove is formed in at least a portion of said buffer element body portion, wherein an alignment protrusion extends from a portion of said locking collar, and wherein interaction of said alignment groove and said alignment protrusion maintains said locking collar in a desired rotational position relative to said body element.

6. The adjustable buffer of claim 1, wherein said alignment groove is formed along a longitudinal axis of said buffer element body portion.

7. The adjustable buffer of claim 1, wherein said buffer element head portion has a greater outer diameter than an outer diameter of said buffer element body portion.

8. The adjustable buffer of claim 1, further comprising an end cap, wherein at least a portion of said end cap extends from said elongate buffer element body portion.

9. The adjustable buffer of claim 1, wherein a position of said collar nut along said buffer element body portion can be adjusted by rotation of said collar nut relative to said buffer element body portion, via interaction of said externally threaded portion of said buffer element body portion and said internally threaded portion of said collar nut.

10. The adjustable buffer of claim 1, wherein said locking collar aperture is sized so as to be repeatably slidable along at least a portion of said buffer element body portion.

11. The adjustable buffer of claim 1, wherein when said locking collar is abutted against said collar nut, interaction of mating locking collar recesses and locking collar protrusions maintain said locking collar in a rotational position relative to said collar nut.

12. An adjustable buffer, comprising:

a buffer element, wherein said buffer element comprises an elongate buffer element body portion extending from a buffer element head portion, wherein said buffer element body portion includes an externally threaded portion, and wherein said buffer element comprises an internal buffer element cavity;

a collar nut, wherein a collar nut aperture is formed through said collar nut, wherein at least a portion of said collar nut aperture is internally threaded, wherein said internally threaded portion is threaded so as to interact with said externally threaded portion of said buffer element body portion, and wherein a position of said collar nut along said buffer element body portion can be adjusted by rotation of said collar nut relative to said buffer element body portion; and a locking collar, wherein a locking collar aperture is formed through said locking collar, wherein said locking collar aperture is formed so as to accept at least a portion of said buffer element body portion therethrough.

13. The adjustable buffer of claim 12, wherein said internal buffer element cavity is defined by an open end, one or more side walls, and a bottom wall.

14. The adjustable buffer of claim 12, wherein an alignment groove is formed in at least a portion of said buffer element body portion, wherein an alignment protrusion extends from a portion of said locking collar, and wherein interaction of said alignment groove and said alignment protrusion maintains said locking collar in a desired rotational position relative to said body element.

15. The adjustable buffer of claim 12, wherein one or more collar nut recesses are formed in said collar nut, wherein one or more locking collar protrusions are formed in said locking collar, wherein said one or more locking collar protrusions are mateable with said one or more collar nut recesses, and wherein when said locking collar is abutted against said collar nut, interaction of mating locking collar recesses and locking collar protrusions maintain said locking collar in a rotational position relative to said collar nut.

16. The adjustable buffer of claim 12, wherein one or more collar nut recesses are formed in said locking collar, wherein one or more locking collar protrusions are formed in said collar nut, and wherein said one or more locking collar protrusions are mateable with said one or more collar nut recesses, and wherein when said locking collar is abutted against said collar nut, interaction of mating locking collar recesses and locking collar protrusions maintain said locking collar in a rotational position relative to said collar nut.

17. The adjustable buffer of claim 12, wherein saki position of said collar nut along said buffer element body portion can be adjusted by rotation of said collar nut relative to said buffer element body portion, via interaction of said externally threaded portion of said buffer element body portion and said internally threaded portion of said collar nut.

18. The adjustable buffer of claim 12, wherein said locking collar aperture is sized so as to be repeatably slidable along at least a portion of said buffer element body portion.

19. An adjustable buffer, comprising:

a buffer element, wherein said buffer element comprises an elongate buffer element body portion extending from a buffer element head portion, wherein said buffer element body portion includes an externally threaded portion;

a collar nut, wherein a collar nut aperture is formed through said collar nut, wherein at least a portion of said collar nut aperture is internally threaded, wherein said internally threaded portion is threaded so as to interact with said externally threaded portion of said buffer element body portion, and wherein a position of said collar nut along said buffer element body portion can be adjusted by rotation of said collar nut relative to said buffer element body portion; and a locking collar, wherein said locking collar includes one or more locking collar protrusions mateable with one or more collar nut recesses.

20. The adjustable buffer of claim 19, further comprising a locking collar aperture formed through said locking collar, wherein said locking collar aperture is formed so as to accept at least a portion of said buffer element body portion therethrough.

* * * * *